United States Patent [19]

Stedman

[11] 4,077,141

[45] Mar. 7, 1978

[54] TIRE PROTECTOR ASSEMBLY FOR A WHEEL LOADER

[75] Inventor: Robert N. Stedman, Chillicothe, Ill.

[73] Assignee: Caterpillar Tractor Co., Peoria, Ill.

[21] Appl. No.: 721,656

[22] Filed: Sep. 8, 1976

[51] Int. Cl.[2] ..... E02F 3/76

[52] U.S. Cl. ..... 37/117.5; 172/801; 214/131 R; 280/152 R; 280/153 A

[58] Field of Search ..... 37/117.5, DIG. 3, 44, 37/50; 214/DIG. 5, 131 R, 145 R; 280/152 R, 153 A; 172/276, 801–809, 277

[56] References Cited

U.S. PATENT DOCUMENTS

| | | | |
|---|---|---|---|
| 2,663,099 | 12/1953 | Klages | 37/117.5 X |
| 2,755,092 | 7/1956 | Donahoe | 37/117.5 X |
| 2,755,572 | 7/1956 | Pilch | 37/117.5 |
| 2,757,746 | 8/1956 | Biedess | 37/117.5 |

FOREIGN PATENT DOCUMENTS

| | | | |
|---|---|---|---|
| 262,510 | 9/1964 | Australia | 37/117.5 |
| 112,125 | 10/1967 | Norway | 37/117.5 |
| 88,265 | 9/1956 | Norway | 37/117.5 |
| 601,331 | 5/1948 | United Kingdom | 37/117.5 |

*Primary Examiner*—E. H. Eickholt

*Attorney, Agent, or Firm*—Wegner, Stellman, McCord, Wiles & Wood

[57] ABSTRACT

A wheel loader having a pair of lift arms pivotally mounted to the frame of the loader and a bucket pivotally connected to and moved by the lift arms includes a tire protector assembly having one or more deflector blade members pivotally mounted to the frame of the loader, the blade members being moved adjacent the ground forward of the wheels when the bucket is lowered so that the wheels of the loader are protected from damage and moved away from the ground when the bucket is raised. The deflector blade members may be mounted on levers or linkages which are pivotally connected to the loader or they may be mounted on the lift arms of the bucket so that the blade members are moved therewith.

13 Claims, 12 Drawing Figures

20
36
34
47
48
50
45
74
44
49
21
41
31
72
33
28
51
27
54
38
55
53
42
26
30
67
24
70
23
59
58
62
64
39

65
58
24
38
68
71
30
60
35
27
62
38
28
34
67
70
30
59
38
23
33
64

TIRE PROTECTOR ASSEMBLY FOR A WHEEL LOADER

BACKGROUND OF THE INVENTION

This invention relates generally to earth-working vehicles and, more particularly, to a tire protector assembly for earth-working vehicles such as wheel loaders.

It is a common practice in wheel loaders to have a loader bucket movable between a lower position for picking up material and an upper position for transporting the material. Commonly, the loader bucket is as wide as the lateral span of the wheels. However, due to the large size of today's earth-working machines, the loader bucket is often wider than the length or width of the bed of a dump truck. Hence, when material is dumped from the loader bucket into the truckbed or into other areas having a width the same or smaller than the width of the loader bucket, considerably spillage can result. In order to avoid this spillage problem, the relatively wide bucket is temporarily removed from the lift arms of the loader and replaced with a narrower bucket having a width which is approximately 30 percent narrower than the truck bed length. However, when such a narrow bucket is used, the tires of the loader are not protected by the bucket since the loader was designed to employ a wide bucket. As a result, the tires become vulnerable to damage.

The tires employed in a wheel loader of this type are very large and very expensive. Nevertheless, they are easily damaged. When the loader is used for digging with the bucket lowered to a position adjacent the ground, the loader is driven forwardly into the material to be picked up, thereby moving the tires directly into the material. Normally the buckets would clear a path through which the tires would move. If a narrow bucket is employed, the path cleared is not as wide as the lateral span of the tires. Therefore, the tires are traveling over an area which may have rocks and other hazardous material which has not been removed by the bucket and could easily ruin the tread on the tires or puncture the tires. Because replacement or repair of this type of tire is both expensive and time-consuming, subjecting the tires to this type of hazard is highly undesirable.

SUMMARY OF THE INVENTION

It is the principal object of the invention to provide a simple and inexpensive means for protecting the tires of a wheel loader when a relatively narrow bucket is employed. More specifically, it is an object of the invention to provide such a tire protection means which is positioned adjacent the ground forward of the front tires when the bucket is in lowered digging position and is raised off the ground when the bucket is raised to an upper transporting position.

In an exemplary embodiment of the tire protector assembly constructed according to the invention, a deflector blade is pivotally secured to the main frame of the wheel loader so it swings between a lower position in front of the wheels rearward of the bucket adjacent to the ground, and a raised position remote from the ground.

In one embodiment of the invention, a pair of forwardly extending lever arms are pivotally secured at their rearward ends to the main frame of the loader and carry the deflector blades at their forward ends. Springs interconnect lever arms and the frame to bias the lever arms and the deflector blade upward to a raised position. When the bucket is lowered, the lift arms mounting the bucket to the loader contact the upper portion of the deflector blade so that the deflector blade is also lowered. When the bucket is raised, spring force raises the deflector blade.

In another embodiment of the invention, the lever arms are pivotally secured to the housing of the front axle of the loader and are directly connected to the lift arm by actuating links. As a result, when the bucket is raised by raising the lift arms, the actuating links also raise the deflector blade. When the bucket is lowered by lowering the lift arms, the actuating links swing the deflector blade about the axle housing to a lowered position adjacent the ground.

In yet another embodiment of the invention, the deflector blade is pivotally secured to the main frame of the loader by a parallelogram linkage having a spring connected between two opposite corners extending along a diagonal. The spring tends to shorten the distance along the diagonal thereby biasing the deflector blade to a raised position. When the bucket is lowered by lowering the lift arm, the lift arms contact the top of the deflector blade to lower the blade downward to a position adjacent the ground in front of the front tires against the action of the spring.

In two other embodiments of the invention, the deflector blades are disposed either on the lift arms themselves or on the bucket and extend outwardly therefrom so that the distance spanned by the bucket and the deflector blades is as great as the lateral span of the wheels. As a result, the deflector blades are lowered and raised along with the bucket and lift arms to provide excellent protection for the tires.

DESCRIPTION OF THE PREFERRED EMBODIMENTS

Figure 1:
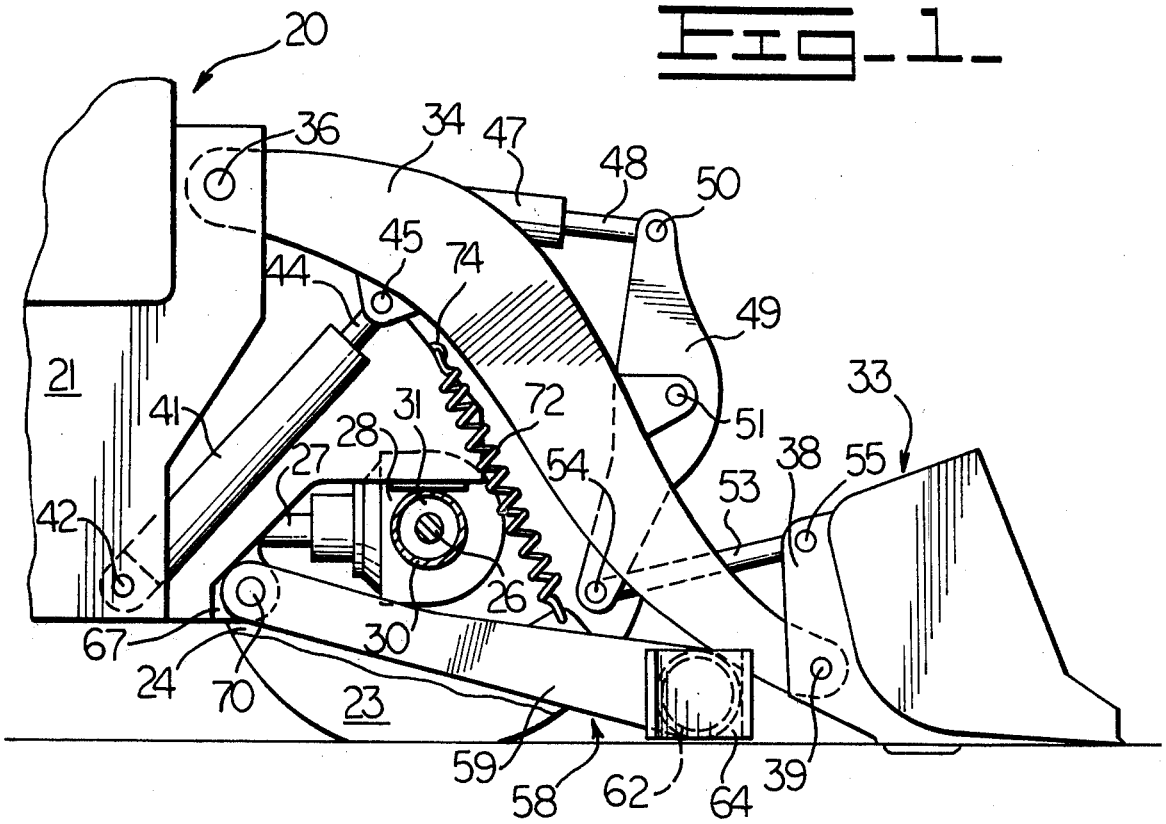
FIG. 1 is a fragmentary side elevational view of the front end of a wheel loader with the right front wheel cut away to show one embodiment of the tire protector assembly in a lowered position.
Figure 2:
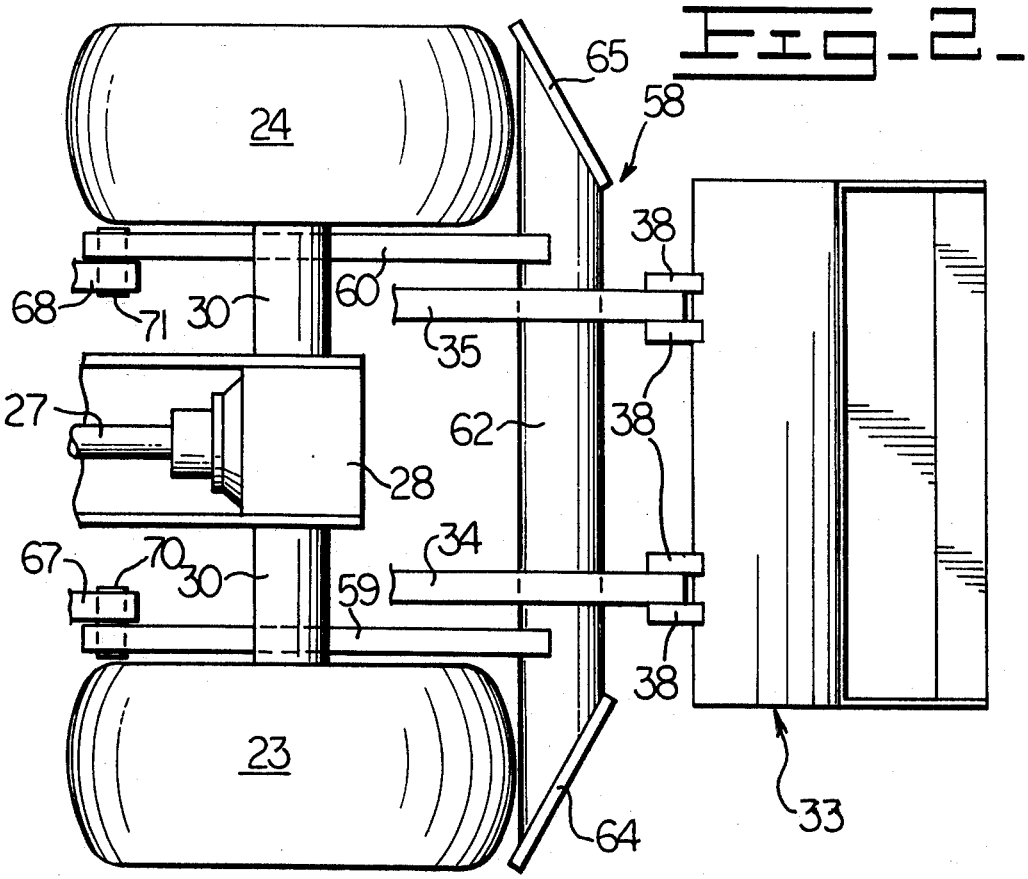
FIG. 2 is a top view of the wheel loader shown in FIG. 1.

An example of a wheel loader in which any of the forms of the tire protector assembly may be employed is illustrated in FIGS. 1 and 2, and is seen to include a vehicle, a forward portion being generally designated 20, having a main frame 21 supported by and traveling on a plurality of wheels with rubber tires disposed on either side of the frame 21, the front wheels being designated 23 and 24 respectively. The front wheels 23 and 24 are mounted on a front axle 26 which is rotatably driven by an engine (not shown) through a drive shaft 27 and a differential 28. A front axle housing 30, having a bearing 31, rotatably mounts the front axle 26 on the vehicle frame 21.

Forwardly of the front end of the frame 21 is a bucket generally designated 33. The bucket 33 is secured to the frame 21 by means of a pair of lift arms 34 and 35, each of which has its rearward end pivotably secured by pivot 36 to an upper portion of the frame 21. The lift arms 34 and 35 are positioned to swing along an arcuate path extending between the wheels 23 and 24. The bucket 33 is pivotally secured to the forward end of the lift arms 34 and 35 by means of clevis-type connections, each including brackets 38 on the bucket 33 and bucket pins 39. As seen in FIG. 2, the bucket 33 has a width less than the lateral span of the wheels 23 and 24.

As will be recognized by those skilled in the art, the vertical attitude lift arms 34 and 35, and hence the height of the bucket 33, may be varied by the operation of hydraulic jacks, each having a cylinder 41 pivotally secured by pivot 42 to the frame 21 and having a piston rod 44 pivotally secured by pivot 45 to its respective lift arm 34 and 35 remote from the pivot 36. Orientation of the bucket 33 relative to the lift arms 34 and 35 for dumping and the like is accomplished through the operation of a pair of tilt jacks; each having a tilt cylinder 47 connected to the frame 21 and a piston rod 48 pivotally secured to a tilt lever 49 by pivot 50. Each tilt lever 49 in turn is pivotally secured to its respective lift arm 34 or 35 by pivot 51. A tilt link 53 has one end pivotally secured to the tilt lever 49 by pivot 54 and its other end pivotally secured to the bucket 33 by pivot 55.

Because the parts of the wheel loader are similar in all of the drawings, for purposes of brevity and clarity, similar parts in the various figures will retain the same identifying numerals.

Figure 3:
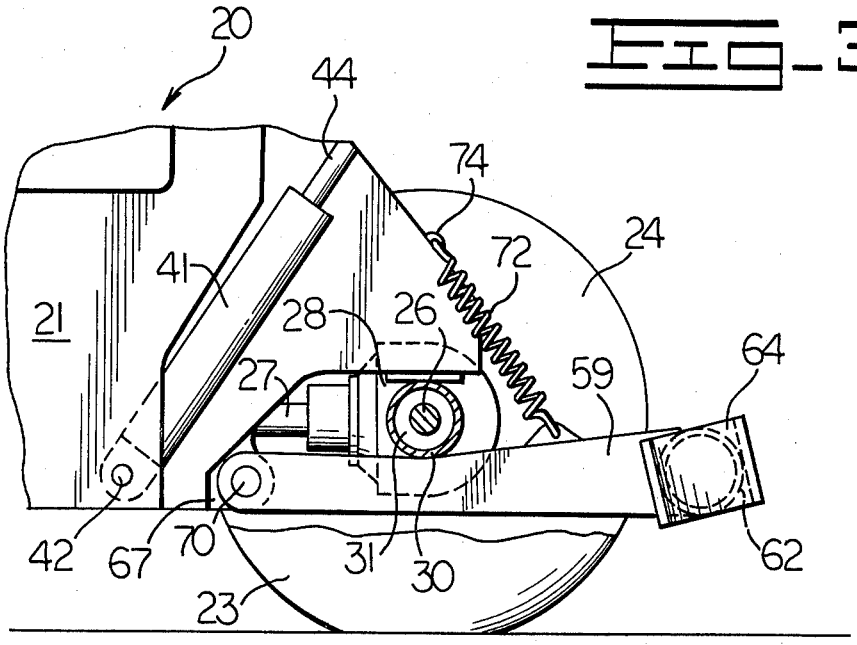
FIG. 3 is a fragmentary side elevational view of a portion of the wheel loader of FIG. 1 showing the tire protector assembly in a raised position.

One exemplary embodiment of the invention is shown in FIGS. 1–3. Here, the tire protector assembly, generally designated 58, includes a pair of lever arms 59 and 60, a cross tube 62 secured to the forward ends of the lever arms 59 and 60 and extending laterally across the forward end of the frame 21, and angled deflector plates 64 and 65 carried at each end of the cross tube 62. The lever arms 59 and 60 extend rearwardly and are pivotally secured to the projecting frame parts 67 and 68 by pivots 70 and 71, respectively, at a position rearwardly of the below the axle housing 30. Springs, one of which is designated 72, are secured between the respective lever arms 59 and 60 and a respective loop, one of which is designated 74, attached to the frame 21 to bias the deflector assembly 58 upwardly.

The cross tube 62 spans the space between the lift arms 34 and 35 to suitably position the deflector plates 64 and 65 directly forwardly of the wheels 23 and 24, respectively. When the lift arms 34 and 35 are lowered, they contact the upper portion of the cross tube 62 so that upon continued downward motion of the lift arms 34 and 35, the cross tube 62 and the angled deflector plates 64 and 65 are also lowered. When the bucket 33 is at a lowered position adjacent the ground (FIG. 1), the deflector plates 64 and 65 are at an operative position adjacent the ground forward of the wheels 23 and 24 to protect the tires from possible damage by rocks or the like. When bucket 33 and the lift arms 34 and 35 are raised, the deflector assembly 58 is urged by the spring 72 to pivot upwardly about the pivots 70 and 71 until the lever arms 59 and 60 contact the lower portion of the axle housing 30 (FIG. 3) so that further upward motion of the deflector assembly 58 is prevented. With the deflector assembly 58 moved to inoperative position, the vehicle 10 can be driven forwardly without resistance caused by the deflector assembly 58 sliding along the ground.

Figure 4:
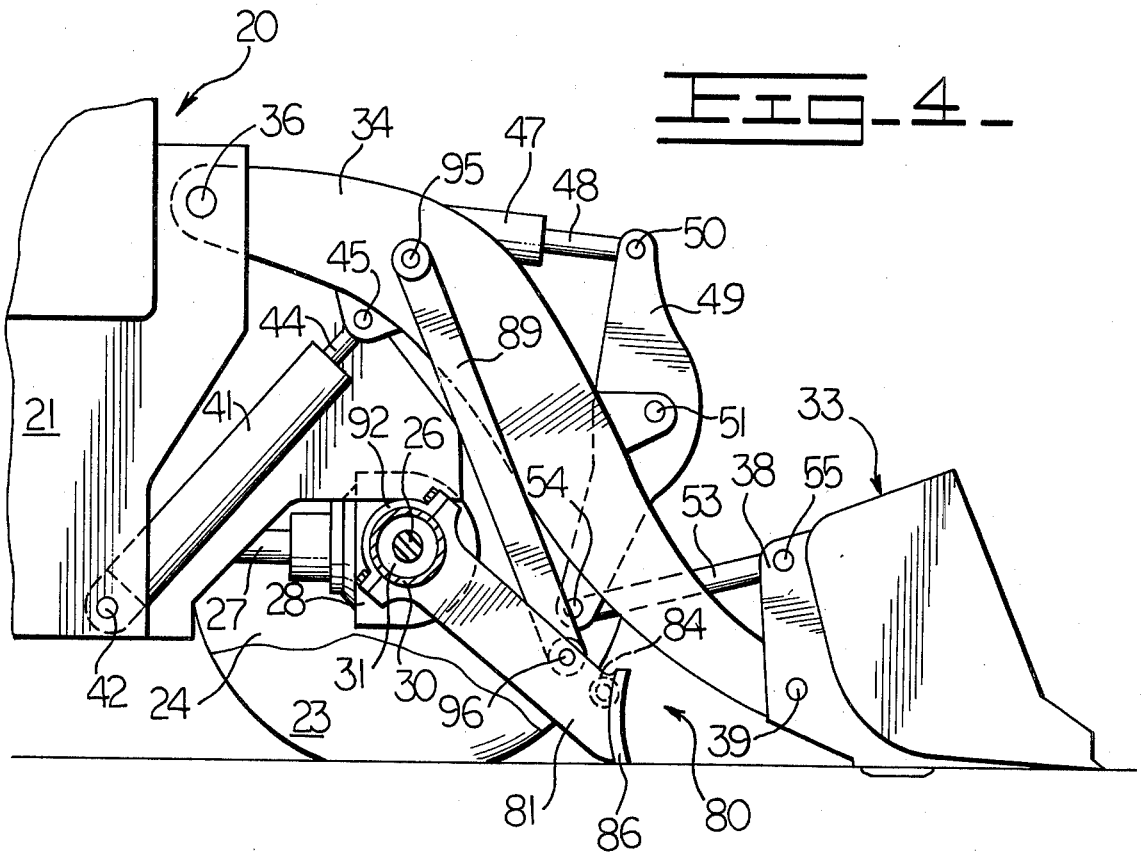
FIG. 4 is a fragmentary side elevational view of the front end of a wheel loader with the right front wheel cut away similar to FIG. 1, but showing a second embodiment of the tire protector assembly in a lowered position.
Figure 5:
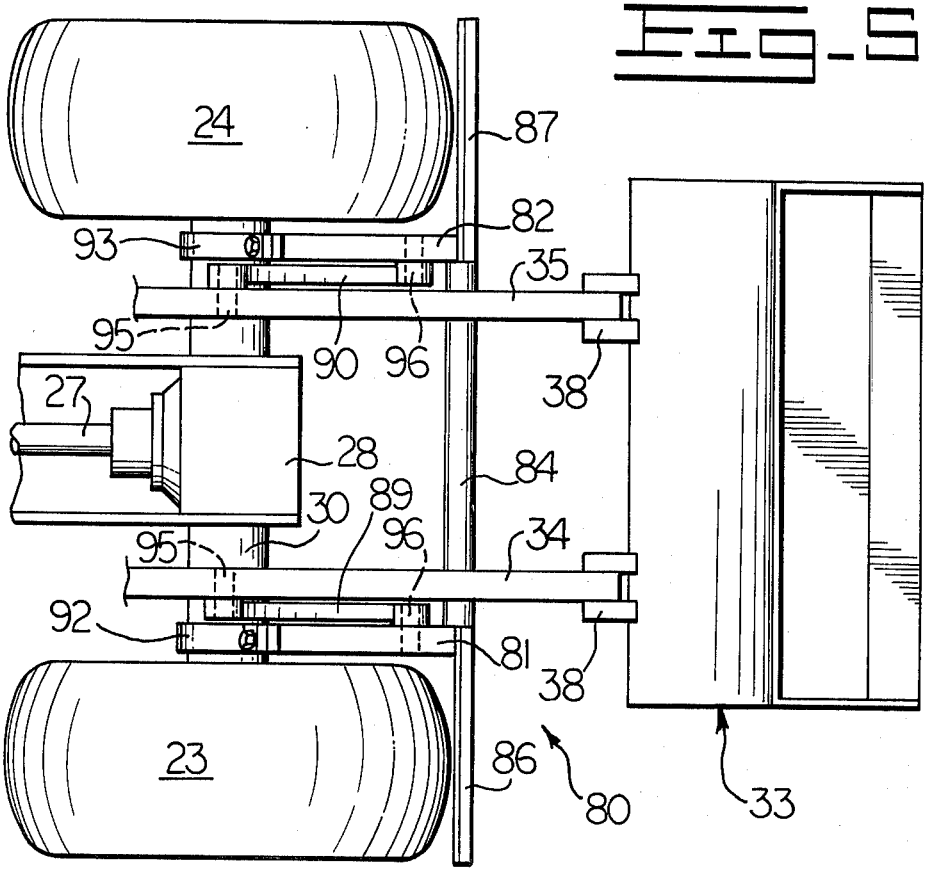
FIG. 5 is a top view of the wheel loader shown in FIG. 4.
Figure 6:
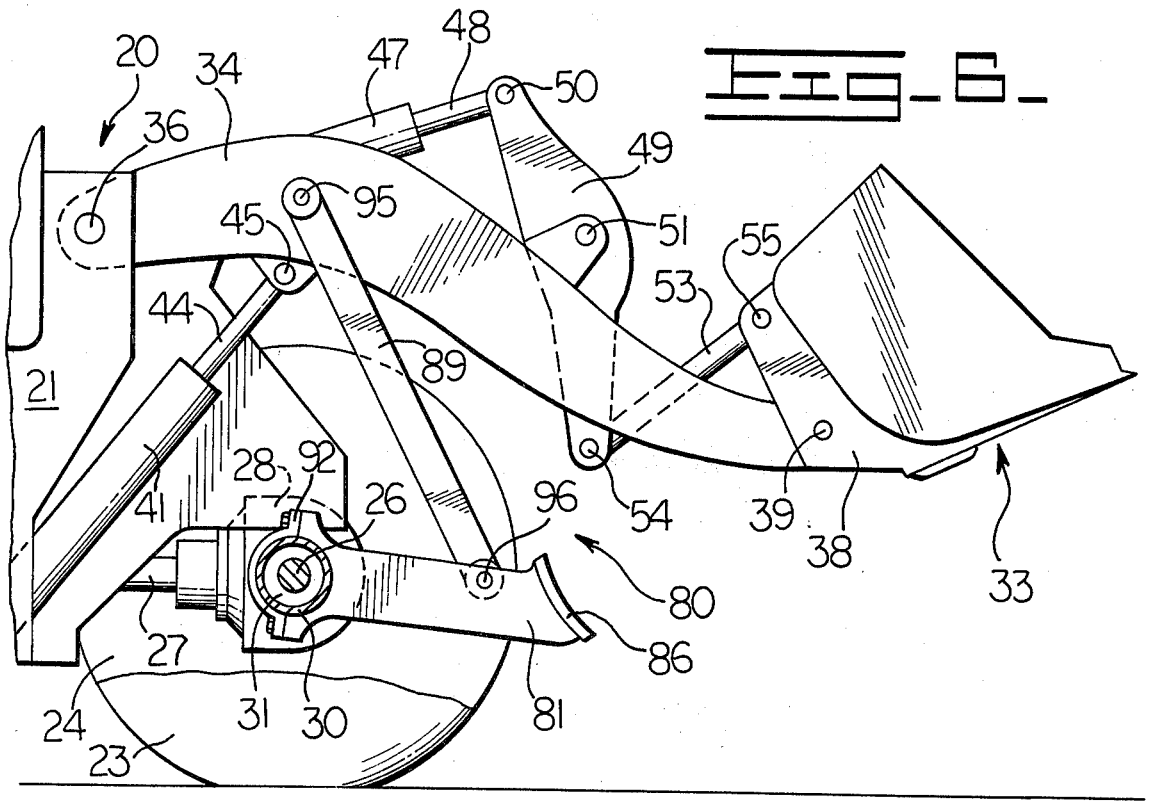
FIG. 6 is a fragmentary side elevational view of the wheel loader of FIG. 4 showing the bucket and the tire protector assembly in a raised position.

A second exemplary embodiment of the tire protector assembly is illustrated in FIGS. 4–6. Here, a tire protector assembly, generally designated 80, includes a pair of lever arms 81 and 82 having their rearward ends shackled to the exterior of the front axle housing 30, a cross tube 84 extending laterally across the forward end of the frame 21, a pair of deflector blades 86 and 87 carried at the ends of the cross tube 84 and secured to the forward ends of the lever arms 81 and 82 to be positioned forward of the front wheels 23 and 24, and a pair of actuating links 89 and 90 connected between the lift arms 34 and 35 and the lever arms 81 and 82, respectively. The lever arms 81 and 82 are shackled to the front axle housing 30 by forming a semicircular recess (not numbered) in each of the rearward end of the lever arms 81 and 82 in which the front axle housing 30 is disposed and bolting arcuate members 92 and 93 to the respective lever arms 81 and 82 to close the recess so that the lever arms 81 and 82 are pivotally secured on the front axle housing exterior. Each of the actuating links 89 and 90 is pivotally secured to its respective lift arm 34 an 35 by pivot 95 and is pivotally secured to its respective lever arm 81 or 82 by pivot 96.

Thus, when the lift arms 34 and 35 are lowered, the actuating links 89 and 90 swing the lever arms 81 and 82, with the deflector blades 86 and 87 toward the ground to a lowered operative position shown in FIG. 4 forward of the wheels 23 and 24. When the lift arms 34 and 35 are raised, the actuating links 89 and 90 lift the lever arms 81 and 82 with the deflector blades 86 and 87 so that they are swung about the front axle housing 30 to a raised inoperative position remote from the ground as shown in FIG. 6.

Figure 7:
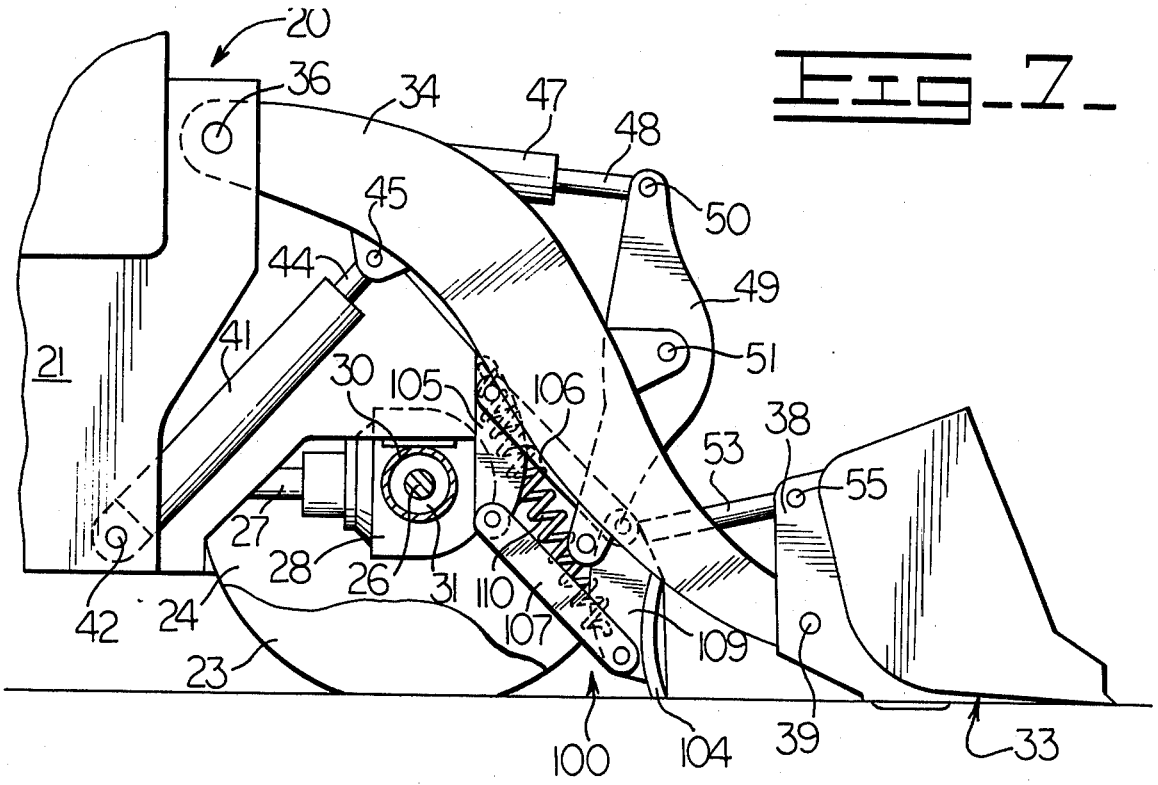
FIG. 7 is a fragmentary side elevational view of the front end of a wheel loader with the right front wheel cut away similar to FIG. 1, but showing a third embodiment of the tire protector assembly in a lowered position.
Figure 8:
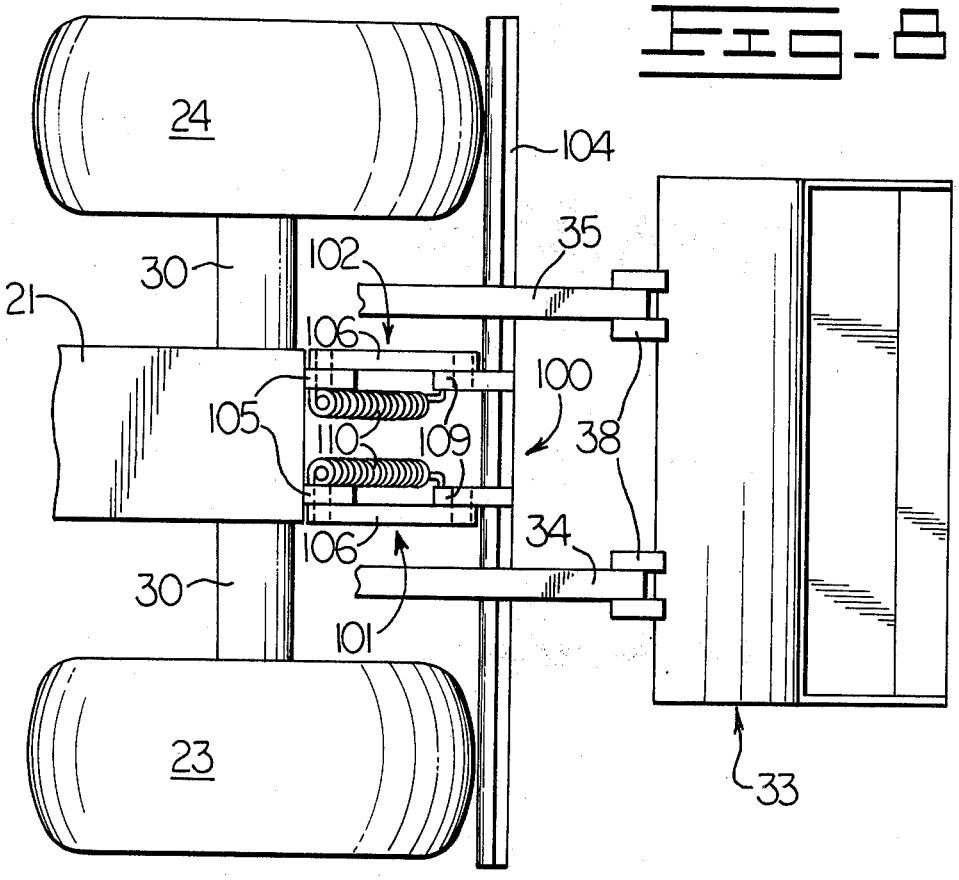
FIG. 8 is a top view of the wheel loader shown in FIG. 7.

A third exemplary embodiment of the invention is shown in FIGS. 7 and 8. Here, a tire protector assembly, generally designated 100, includes a pair of parallellogram linkage assemblies generally designated 101 and 102, secured to the forward end of the main frame 21 and an arcuate deflector blade 104 secured to the linkage assemblies 101 and 102 and extending laterally across the forward end of the frame 21. Each of the linkage assemblies 101 and 102 includes a rearward upright link 105 which is secured to or formed integrally with the main frame 21, a pair of forwardly extending parallel links 106 and 107, a forward, upright link 109 which is secured to or is formed integrally with the blade 104, and a spring 110 extending across one diagonal of each linkage assembly 101 and 102. The link 106 has its rearward end pivotally connected to upper end of the link 105 and its forward end pivotally connected to the upper end of the link 109. The link 107 has its rearward end pivotally connected to the lower end of the link 105 and its forward end pivotally connected to the lower end of the link 109.

The blade 104 spans the space between the lift arms 34 and 35 so that when the lift arms 34 and 35 are lowered, they contact the upper portion of the blade 104, and upon continued downward motion of the lift arms 34 and 35, the blade 104 is lowered. When the bucket 33 is at a lowered position adjacent the ground (FIG. 7), the blade 104 is positioned adjacent the ground forward of the wheels 23 and 24. As seen in FIG. 7, the rear link 105 is positioned rearwardly of the blade 104 and upwardly from the ground so that when the blade 104 is lowered, the spring 110 extends from the top of the rear link 104 across the long diagonal to the bottom of the forward link 109 tending to bias the corners of the linkage assembly together thereby urging the blade 104 upwardly. When the distance in which the spring 110 acts is less than the length of the spring 110 in its unstressed state, upward movement of the blade 104 ceases.

Figure 9:
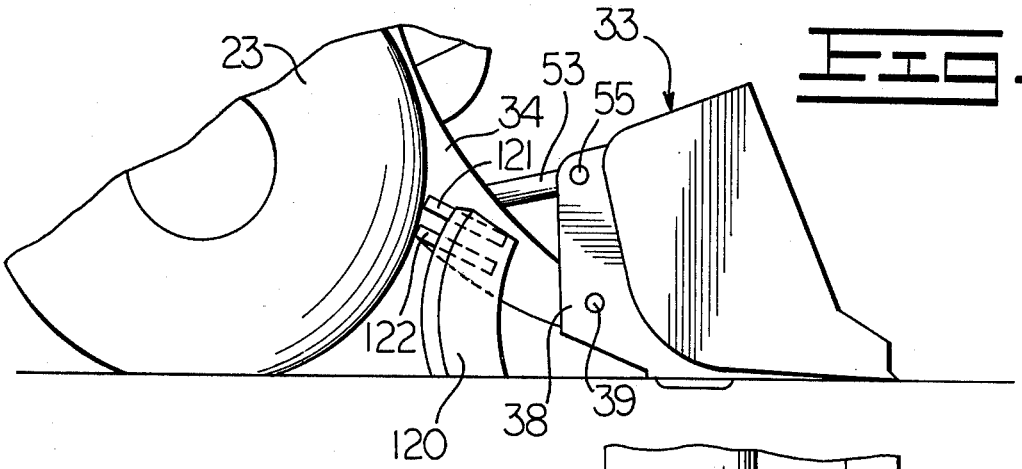
FIG. 9 is a fragmentary side elevational view of the front end of a wheel loader showing a fourth embodiment of the tire protector assembly in a lowered position.
Figure 10:
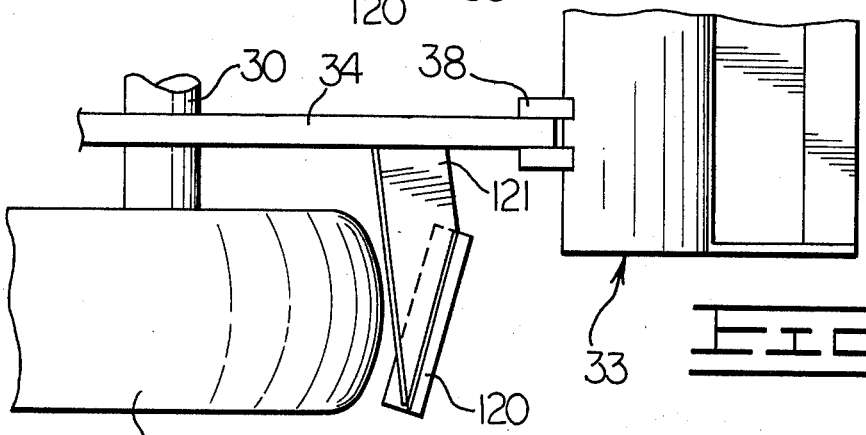
FIG. 10 is a fragmentary top view of the wheel loader shown in FIG. 9.

Yet another embodiment of the invention is shown in FIGS. 9 and 10. Here, an angled arcuate deflector blade 120 is secured outwardly from the lift arm 34 by a pair of laterally extending support brackets 121 and 122 which position the deflector blade 120 rearward of the bucket 33 and forward of the front wheel 23. Another deflector blade would be similarly secured to the opposite lift arm 35. When the bucket 33 is positioned adjacent the ground, the deflector blade 120 is also positioned adjacent the ground forward of the wheel 23 (FIG. 9). When the bucket 33 is raised, the lift arm 34 is also raised, thus raising the deflector blade 120 from its lowermost position.

Figure 11:
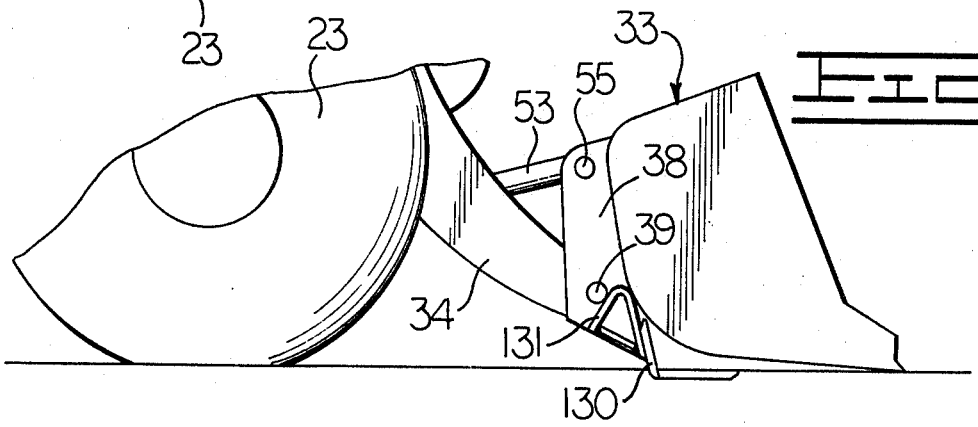
FIG. 11 is a fragmentary side elevational view of the front end of a wheel loader showing a fifth embodiment of the tire protector assembly in lowered position.
Figure 12:
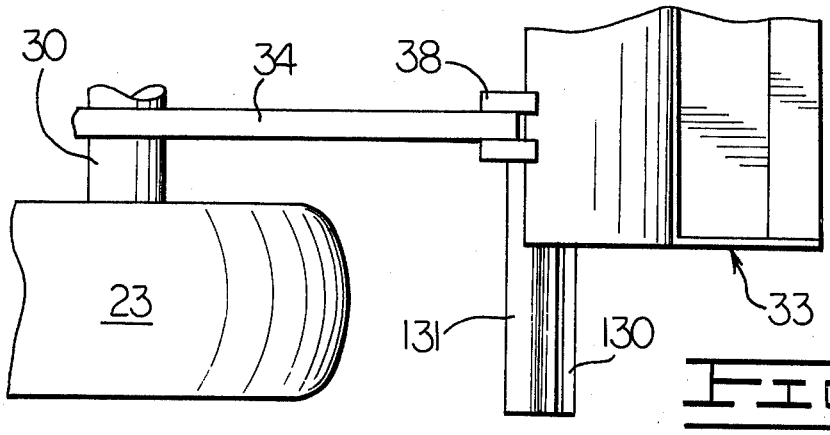
FIG. 12 is a fragmentary top view of the wheel loader shown in FIG. 11.

An embodiment of the invention similar to that shown in FIGS. 9 and 10, is illustrated in FIGS. 11 and 12. Here a deflector blade 130 is carried by a support bracket 131 which, in turn, is carried by the bucket 33. The deflector blade 130 is positioned at the rearward end of the bucket 33 and extends laterally outward from the bucket 33. A similar deflector blade and support bracket is mounted on the other side of the bucket 33 so that the bucket 33 and the deflector blades 130 span the distance spanned by the front wheels 23 and 24.

What is claimed is:

1. A wheel loader comprising:

a frame;

a plurality of wheels for supporting said frame and effecting travel thereof over the ground including a pair of front wheels one on each lateral side of said frame, said front wheels defining a lateral wheel span;

a pair of lift arms one on each lateral side of said frame so as to flank said frame, each lift arm having its rearward end pivotally secured to the frame rearwardly of said front wheels, said lift arms extending forwardly therefrom between said frame and their respective front wheels;

a bucket extending between and pivotally secured to said lift arms at the forward ends thereof remote from their pivotal connection to said frame, the lateral width of said bucket being less than the lateral wheel span, pivotal motion of said lift arm moving said bucket between a lowered digging position forward of the frame and wheels adjacent the ground and a raised transporting position above the ground;

deflector means located forwardly of said front wheels for deflecting material away from the front wheels, said deflector means and said bucket together spanning a width at least as great as the lateral wheel span;

means movably mounting said deflector means to the loader for movement between a lowered operative position adjacent the ground forward of the front wheels and a raised inoperative position remote from the ground; and means for moving said deflector means solely in response to movement of said bucket so that said deflector means is moved toward its lowered position as said bucket is moved downwardly, and toward its raised position as the bucket is moved upwardly, whereby said deflector means and said bucket, when lowered, are operative to clear a path through which the wheels move at least as wide as the lateral wheel span so as to prevent damage to the wheels of the wheel loader.

2. The wheel loader of claim 1 wherein said deflector means includes a laterally extending blade member and said mounting means includes a pair of laterally spaced lever arms, each of said lever arms having one end secured to said blade member and its other end pivotally secured to the loader.

3. The wheel loader of claim 2 wherein said blade member includes a central support member and a pair of deflector blades disposed at opposite ends of the support member forward of the front wheels.

4. The wheel loader of claim 2 wherein each of said lever arms has its one end pivotally secured about the housing for the front axle of the loader which mounts the front wheels so that said blade member swings pivotally thereabout.

5. The wheel loader of claim 2 wherein said means for moving said deflector means includes sping means acting between the frame and said deflector means for biasing said blade member to a raised position, said blade member being disposed intermediate the lift arms and the ground in the path of travel of the lift arms, said lift arms, when lowered, contacting said blade member to move said blade member downward therewith against the action of said spring means to a lowered position.

6. The wheel loader of claim 5 wherein said lever arms are secured rearwardly and downwardly from the front axle of the loader which mounts the front wheels, the housing for the front axle thereby limiting upward movement of said lever arms and said blade member.

7. The wheel loader of claim 1 wherein said means for moving said deflector means includes a link member connected between each of the lift arms and said deflector means such that said deflector means is raised when the lift arms are raised and lowered when the lift arms are lowered.

8. The wheel loader of claim 7 wherein said deflector means includes a laterally extending blade member and said mounting means includes a pair of laterally spaced lever arms, each of said lever arms having one end secured to said blade member and its other end secured to the loader.

9. The wheel loader of claim 8 wherein said link member is connected between a lift arm and a lever arm.

10. The wheel loader of claim 1 wherein said deflector means includes an arcuate blade member extending laterally across the forward end of the loader having a width as great as the lateral span of the front wheels.

11. The wheel loader of claim 1 wherein said deflector means includes a laterally extending blade member and said mounting means includes a pair of parallelogram linkage assemblies, each of said linkage assemblies having four links, one of said links being carried upright by the frame of the loader, another link opposite said one link being carried upright by said blade member forward of said one link, the two remaining links being connected between said one link and said other link at their top and bottom ends, respectively, and a spring connected between the upper end of said one link and the lower end of said other link to bias the ends together, thereby urging said blade member upwardly away from the ground, said blade member being disposed intermediate the lift arms and the ground in the path of travel of the lift arms, said lift arms, when lowered, contacting said blade member to move said blade member downward therewith against the action of the spring to a lowered position.

12. The wheel loader of claim 1 wherein said deflector means includes a pair of deflector blades, one deflector blade being secured to each lift arm and extending laterally outward therefrom outboard of the bucket so that when the bucket is lowered to a digging position, said deflector blades are lowered to a position adjacent the ground, a deflector blade thereby being positioned forward of each of the front wheels.

13. For use in a wheel loader having a frame driven and supported by a plurality of wheels, a pair of lift arms each of which has one end pivotally secured to the frame, and a bucket secured to each of the lift arms at ends thereof remote from their pivotal connection to the frame, pivotal motion of the lift arms moving the bucket between a lowered digging position forward of the frame and wheels adjacent the ground and a raised transporting position above the ground, a tire protector assembly comprising:

deflector blade means for deflecting material away from the front wheels of the loader including a pair of deflector blades secured to the bucket, said deflector blades being moved toward a lowered operative position as the bucket is moved downwardly to its digging position, and toward a raised inoperative position as the bucket is moved upwardly to its transporting position, one deflector blade extending laterally outward from each side of the bucket so that when the bucket is lowered to a digging position, said deflector blades are lowered to a position adjacent the ground with a deflector blade being positioned forward of each of the front wheels.

* * * * *